United States Patent [19]

Kim

[11] Patent Number: 4,628,703

[45] Date of Patent: Dec. 16, 1986

[54] SELF OPERATIVE COOLING MECHANISM OF CAN

[76] Inventor: Ho Kim, 519-108 Yeunchi-dong, Sebaemoon-ku, Seoul, Rep. of Korea

[21] Appl. No.: 759,834

[22] Filed: Jul. 29, 1985

[30] Foreign Application Priority Data

Jul. 10, 1984 [KR] Rep. of Korea ..... 6557/1984

[51] Int. Cl.[4] ..... F25D 3/10

[52] U.S. Cl. ..... 62/294; 62/371

[58] Field of Search ..... 62/293, 371, 294

[56] References Cited

U.S. PATENT DOCUMENTS

| | | | |
|---|---|---|---|
| 2,900,808 | 8/1959 | Wang | 62/293 X |
| 3,229,478 | 1/1966 | Alonso | 62/371 |
| 3,326,013 | 6/1967 | Jacobs | 62/294 |
| 3,597,937 | 8/1971 | Parks | 62/371 X |
| 3,726,106 | 4/1973 | Jaeger | 62/371 X |
| 3,842,617 | 10/1974 | Chase et al. | 62/371 X |
| 3,987,643 | 10/1976 | Willis | 62/371 |
| 4,054,037 | 10/1977 | Yoder | 62/371 X |

*Primary Examiner*—William E. Wayner

*Attorney, Agent, or Firm*—Price, Heneveld, Huizenga & Cooper

[57] ABSTRACT

A beverage container has a refrigerant compartment in its upper end, the lower wall of which is inclined. A conduit for released refrigerant extends through the lower beverage compartment and is connected to an opening in the side wall of the refrigerant compartment adjacent the compartment's lowest point. A valve is provided between the opening and the conduit to control discharge of the refrigerant. The valve is recessed into a well to protect it from inadvertent actuation.

8 Claims, 4 Drawing Figures

FIG 1
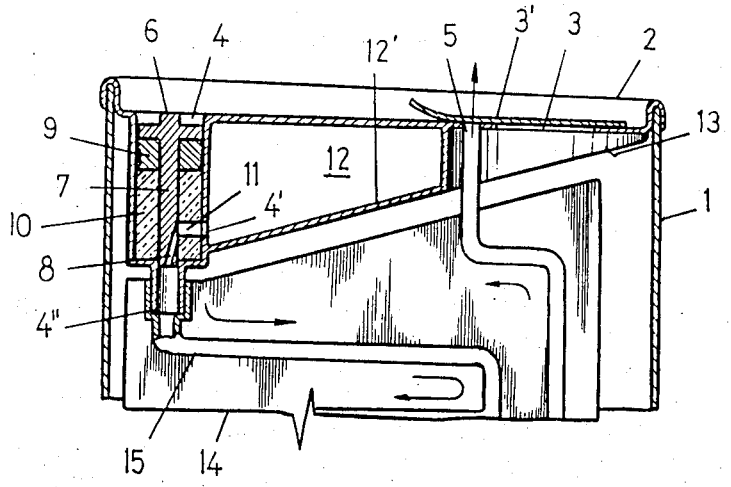
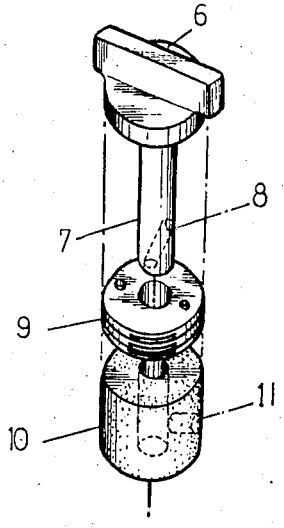
FIG 2

SELF OPERATIVE COOLING MECHANISM OF CAN

THE FIELD OF APPLICATION OF THE INVENTION

The present invention relates to self operative a cooling mechanism for a can containing beverage therein so that the user can have cool and refreshed soft drinks and other beverages which are cooled by the afore-mentioned mechanism instantly at the moment when the cap for the outlet opening is removed.

BACKGROUND OF THE INVENTION

Previously this applicant applied for Utility Model to the Korean Patent Office and it was published by the Notice No. 85-850 of Public Gazette No. 711. It had a cooling mechanism almost identical to the present invention. It, however, had the following several defective structures: The process of charging refrigerant gas into gas chamber and closing it was difficult; due to the flush bottomline of the gas chamber, discharging refrigerant gas by removing the cap for the outlet opening at the top of the can was not easy, consequently requiring tipping of the can to expedite the same process; another structural defect was the ring with the functions of starting the discharge process of refrigerant gas because when it was pressurized inadvertently it touched off accidental discharge of refrigerant gas.

BRIEF DESCRIPTION OF THE DRAWINGS

FIG. 1 is a fragmentary sectional view of the invention.

FIG. 2 is an enlarged expanded oblique view of the inlet valve of the invention.

DESCRIPTION OF THE PREFERRED EMBODIMENT

Figure 3:
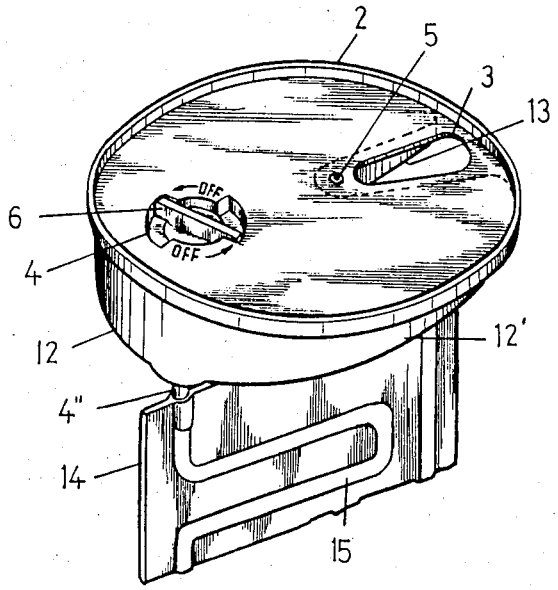
FIG. 3 is an oblique view of the top of the invention.
Figure 4:
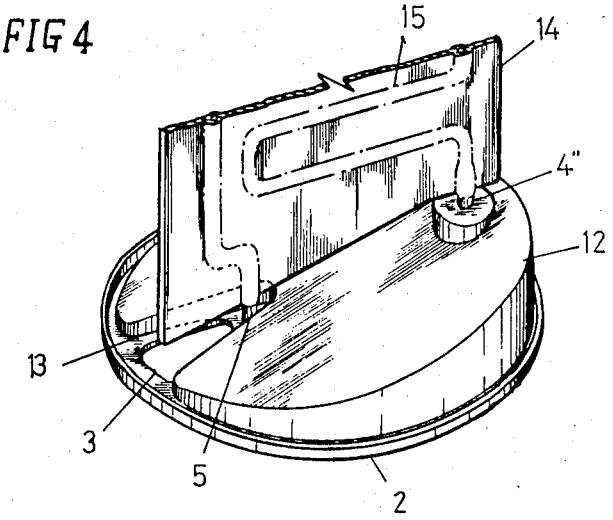
FIG. 4 is an inverted oblique view of the top of the invention.

To achieve the above-mentioned objective, as illustrated in FIG. 1, the bottomline or panel of gas chamber being formed by its connection to indented port provided at the top of can has a sloped structure. When operating rod which is integrally provided with indented port is turned the slanted channel inside of operating rod is matched to an opening to the gas chamber. Then refrigerant gas is supplied through the opening for charging and discharging gas. During the time while refrigerent gas passes through the cooling conduits of cooling plate, the latter is being cooled which in turn cools beverage contained inside of the can.

FIG. 1 shows assembled cooling mechanism according to this invention. First of all, the overall structure of this cooling mechanism is explained. At first top (2) is connected to the upper part of a can (1). On the surface of top (2) a cap for outlet opening (3') is formed at outlet opening (3). Indented port (4) extends downwardly and inwardly and has an opening 4 for charging and discharging gas and an opening into the gas chamber (4'). The gas chamber (12) is formed by a sloped bottomline or (12'). At the upper portion of gas chamber (12) a cut-out or passage (13) is formed. Outlet opening (3) is for the discharge and filling of beverage and gas vent hole (5) is provided.

One side of cooling conduit (15) of cooling plate (14) is extended to the opening for charging and discharging of gas (4'') and fixed thereto. The other end of cooling conduit (15) is extended to gas vent hole (5) and fixed thereto. Into dented port (4) the following parts are inserted in the following described order: first rubber ring (10) is inserted. At this time inside hole (11) of the rubber ring (10) is made to fit the opening at gas chamber (4').

After that gasket (9) illustrated in FIG. 2 is inserted, the outer circumference of gasket (9) has spiral thread functioning as bolt which is tightened to other spirals disposed the upper part as well as the middle part of indented port and gasket (9) retains rubber ring (10) so as to prevent its moving or loosening.

Then operating rod (7) is inserted and assembled. There are many possible ways to charge refrigerant gas. However, charging gas by the following method is in order: At first refrigerant gas is charged through opening 4 for charging and discharging gas (4''). Before connecting it to cooling plate (14) and as so soon as the chamber is filled with gas, then handle or set screw (6), as illustrated in FIG. 3 is turned in the opposite direction of the arrow the slanted channel (8) inside of operating rod being thereby turned and removed from the location of the opening to gas chamber (4') and closing it off. By virtue of the elasticity of rubber ring (10), leakage of gas is forestalled. When the above described process is has been completed then attached cap (3') to outlet opening (3). The front end of cooling conduit (15) of cooling plate (14) is connected to the opening for charging and discharging gas (4'') and other end of it is extended to gas vent hole (5) in the top (2) and fixed thereto.

After completing the above described process of filling can (1) with beverage the cooling plate (14) is placed inside of can and submerged in the beverage. Then top surface (2) and intake portion of can (1) are closed off. The whole work for the installation of the cooling mechanism is completed by this final step as described above.

DETAILED DESCRIPTION OPERATION OF THE PREFERRED EMBODIMENT

When valve or set screw (6) of indented port (4) formed in the surface of top (2) as illustrated in FIG. 3, is turned toward OFF in the direction of the arrow operating rod (7) moves to make slanted channel (8) inside of operating rod (7) match the opening to gas chamber (4') and the inside hole (11) of the rubber ring. At the moment when above mentioned 3 openings are matched, refrigerant gas passes through cooling conduits (15) of cooling plate (14) and vents out via gas vent hole (5) and comes into contact with air. When the vented gas contacts air, cooling plate (14) is cooled instantly and concurrently the beverage contained in the can is cooled by cooling plate (14) submerged therein. After this process, cap for outlet opening (3') is removed and the beverage is discharged by outlet opening (3).

The quantity of refrigerant gas to be charged to gas chamber (12) is dependent on the size of can (1) and consequently adjusted by the size of the gas chamber.

Since the bottomline or wall of the refrigerant gas chamber (12) is, formed as a slope (12') refrigerant gas will be discharged through the opening 4 in gas chamber even when can (1) is not tipped or rattled to expedite gas discharge. Further more this invention provides security against accidental discharge of gas when set screw is placed under unintentional pressure due to mishandling or mistake in transit.

I claim:

1. A beverage container having therein means capable of cooling the contents of the container, said container having a top end panel with a beverage dispensing opening therein, said container having an internal baffle adjacent said top end panel dividing the interior of said container into a refrigerant compartment adjacent said top end panel and a beverage compartment below; said baffle being inclined with respect to said top end panel and downwardly away from said dispensing opening; a well opening through said top end panel and extending through said baffle at the deepest end of said refrigerant compartment; a refrigerant conduit in said beverage compartment having a first end communicating with the bottom of said well and a second end opening through said top end panel; said well being sealed from said refrigerant compartment except for an aperture communicating therewith adjacent said baffle; a valve element seated in said well normally sealing said aperture and moveable to connect said aperture with the end of said conduit to release refrigerant through said conduit for cooling the contents of said beverage compartment.

2. A beverage container as described in claim 1 wherein said valve element is rotatable and has a passage therein communicating with both said aperture and said conduit when rotated to refrigerant release position.

3. A beverage container as described in claim 2 wherein the top of said valve element is recessed into said well.

4. A beverage container as described in claim 2 wherein a resilient seal is seated in said well and surrounds said valve element, an opening through said seal aligned with said aperture and positioned to communicate with the passage in said valve element when the latter is rotated to refrigerant release position.

5. A beverage container as described in claim 4 wherein an externally threaded gasket is threaded into said well to seat said seal and rotatably support said valve element.

6. A beverage container as described in claim 1 wherein a wall is provided in said refrigerant compartment aligned with and surrounding said beverage dispensing opening providing a passage communicating with both said opening and said beverage compartment and extending through and sealed from said refrigerant compartment; removable seal means closing said dispensing opening.

7. A beverage container as described in claim 6 wherein said seal means also covers the second end of said refrigerant conduit.

8. A beverage container as described in claim 7 wherein a panel extends vertically into said beverage compartment below said refrigerant compartment; said conduit being integral with said panel.

* * * * *